US006015263A

United States Patent [19]

Morris

[11] Patent Number: 6,015,263

[45] Date of Patent: Jan. 18, 2000

[54] FLUID MOVING DEVICE AND ASSOCIATED METHOD

[75] Inventor: Garron Morris, Evanston, Ill.

[73] Assignee: Motorola, Inc., Schaumburg, Ill.

[21] Appl. No.: 09/052,681

[22] Filed: Mar. 31, 1998

[51] Int. Cl.[7] ..... B63H 1/26

[52] U.S. Cl. ..... 416/132 A; 416/132 R; 416/1; 416/39; 416/240; 416/228; 415/1; 415/12; 415/47; 415/141

[58] Field of Search ..... 415/12, 119, 47, 415/48, 49, 141; 416/39, 132 R, 132 A, 1, 240, DIG. 5

[56] References Cited

U.S. PATENT DOCUMENTS

| | | | |
|---|---|---|---|
| 3,558,369 | 1/1971 | Wang et al. | 148/563 |
| 3,764,227 | 10/1973 | Albertzart | 416/37 |
| 5,389,888 | 2/1995 | Urano et al. | 315/503 |

OTHER PUBLICATIONS

Shape Memory Alloys, by Hodgson, et al, obtained by accessing: www.sma–inc.com, on Mar. 31, 1998.

*Primary Examiner*—Edward K. Look
*Assistant Examiner*—Ninh Nguyen
*Attorney, Agent, or Firm*—Sayed Hossain Beladi

[57] ABSTRACT

A fluid moving device (100) includes a rotatable assembly (101), and a plurality of fan blades (102–04) disposed circumferentially around and extending outward from rotatable assembly (101), at least one of plurality of fan blades (102–04) includes shape memory alloy. The fan blade which includes shape memory alloy transforms into a predetermined shape memory state when the fan blade experiences a predetermined temperature which may be as a result of a predetermined temperature of surrounding fluid passing over fan blades (102–04) when rotation of rotatable assembly (101) is at a given speed. The shape memory state increases or decreases volume flow of surrounding fluid when rotatable assembly (101) is rotating at substantially a constant speed. The speed is substantially constant which limits noise generated from fluid moving (100) device while volume flow rate of the fluid moving device is being changed.

9 Claims, 2 Drawing Sheets

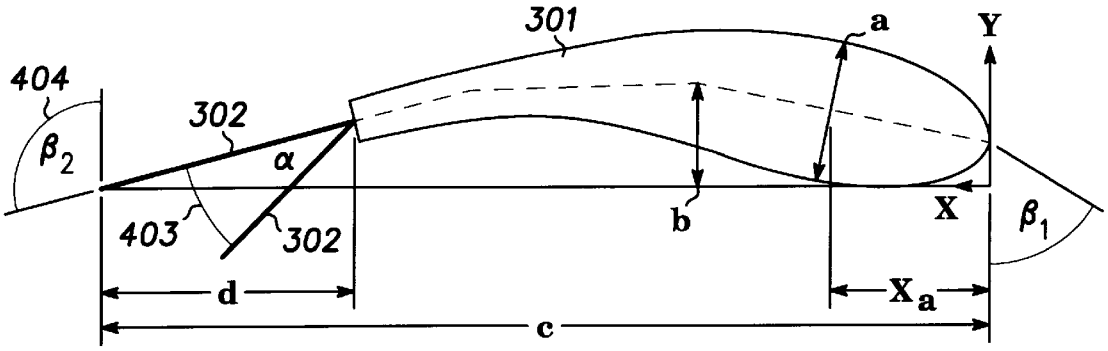

| VARIABLE | DESCRIPTION | RANGE |
|---|---|---|
| **a** | MAXIMUM PROFILE | $0.05 \leq \mathbf{a}/\mathbf{c} \leq 0.20$ |
| **b** | MAXIMUM CAMBER | $0 \leq \mathbf{b}/\mathbf{c} \leq 0.30$ |
| **c** | CHORD LENGTH | 25–60mm |
| **d** | TAIL LENGTH | $0.05 \leq \mathbf{d}/\mathbf{c} \leq 0.50$ |
| $\mathbf{X_a}$ | LOCATION OF MAX. AIRFOIL THICKNESS FROM LEADING EDGE | $0.05 \leq \mathbf{X_a}/\mathbf{c} \leq 0.25$ |
| $\alpha$ | TAIL DEFLECTION ANGLE | $0° \leq \alpha \leq 45°$ |
| $\beta_1$ | ANGLE OF AIRFOIL AT LEADING EDGE | $15° \leq \beta_1 \leq 75°$ |
| $\beta_2$ | ANGLE OF AIRFOIL AT TRAILING EDGE | $15° \leq \beta_2 \leq 150°$ |

*FIG. 4*

FLUID MOVING DEVICE AND ASSOCIATED METHOD

FIELD OF THE INVENTION

The present invention relates to a fluid moving device, and more particularly, to an air moving device.

BACKGROUND OF THE INVENTION

Acoustic noise generated from an air moving device, such as a fan assembly, is problematic in many air cooling applications. As the surrounding air temperature rises, the acoustic noise is increased due to an increase in rotation speed of a rotating assembly in the air moving device. The rotating assembly very often is coupled to a number of fan blades with fix airfoil shape. The rotation speed and airfoil shape of the fan blades determine the volume flow rate of the fluid moving device. Volume flow rate of the device is controlled by controlling the rotation speed to maintain a constant air temperature. The rotation speed is increased or decreased in response to, respectively, a rise or drop in air temperature. Such a control mechanism very often requires a control circuitry which consists of resistors, capacitors, or other types of electronic components which adds to the manufacturing cost and increases power consumption of the fluid moving device.

Therefore, it is highly beneficial to have a fluid moving device which provides low noise operation, and controls its volume flow rate with no or minimal control circuitry.

DESCRIPTION OF THE DRAWINGS

FIG. 4 depicts detail of an airfoil shape of a fan blade coupled with a tail piece.

DETAILED DESCRIPTION OF THE PREFERRED EMBODIMENTS

According to an embodiment of the invention, a fluid moving device includes a rotatable assembly, and a plurality of fan blades disposed circumferentially around and extending outward from the rotatable assembly, wherein at least one of the plurality of fan blades includes a shape memory alloy. The term shape memory alloy is applied to a group of metallic materials that demonstrate the ability to return to some previously defined shape or size when subjected to an appropriate thermal procedure. In a two way shape memory alloy, the alloy transforms its shape or size at a predetermined transform temperature level, and returns to the initial shape or size when the temperature is returned to the initial temperature level. A few of such known alloys are nickel-titanium, copper zinc aluminum, and copper aluminum nickel alloys.

Figure 1:
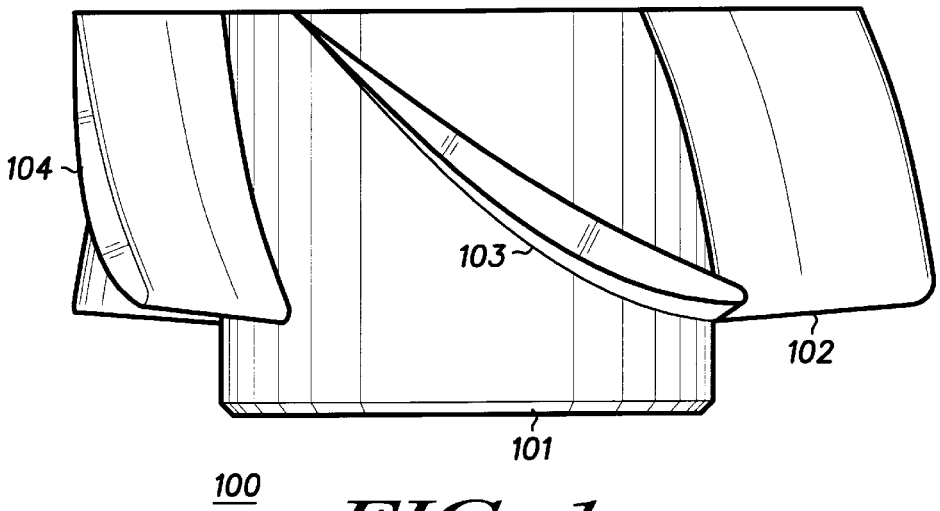
FIG. 1 depicts a rotatable assembly coupled with fan blades.

Referring to FIG. 1, a fluid moving device 100 which includes a rotatable assembly 101 coupled with fan blades 102–04 is shown. Rotatable assembly 101 may be one of a shaft and a hub. At least one of fan blades 102–104 that has the shape memory alloy transforms into a predetermined shape memory state when the fan blade experiences a predetermined transform temperature. Fluid moving device 100 may be mounted on an actuating device such a motor, (not shown), for rotating rotatable assembly 101 to cause flow of the surrounding fluid. When rotation of the rotatable assembly at a given speed causes surrounding fluid to flow, the surrounding fluid passing over the fan blades at substantially a predetermined transform temperature causes the fan blade to transform into substantially a predetermined shape memory state. When the fan blade has the predetermined shape memory state, it increases or decreases volume flow of surrounding fluid. The change in volume flow of surrounding fluid affects the temperature of the fluid.

Figure 2:
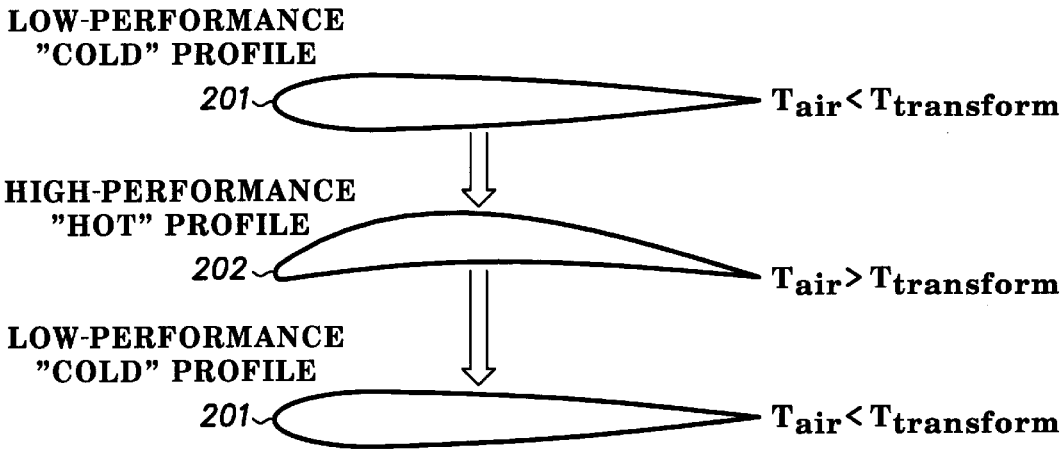
FIG. 2 depicts airfoil shapes of a fan blade before and after a temperature change.

Referring to FIG. 2, for example, if the fluid temperature rises to a predetermined transform temperature level, a fan blade with shape memory alloy changes its initial airfoil shape state 201 to a new airfoil shape state 202. The fan blade with airfoil shape state 202 has a higher fluid moving capacity than the fan blade with airfoil shape state 201, which results in an increase in volume flow rate while the fan is in rotation for a constant rotation rate. The increase in the fluid flow causes the surrounding fluid to return to a temperature below the transform temperature level, and consequently causing the fan blade to return to the initial airfoil shape state 201. When the fan blade changes its airfoil shape from state 202 to 201, it results in a decrease in volume flow rate. The fluid temperature, thus, is controlled by the changes in the airfoil shape of the fan blade caused by the fluid temperature. According to one benefit of the invention, a need for changing the rotation speed to control fluid temperature is eliminated. The rotation of the rotatable assembly is maintained substantially at the given speed, thereby, any noise generated from the rotation is kept at a constant level.

Electronic components very often generate heat while in operation. Such components must be cooled in order to maintain their optimum operating conditions. An air cooling device is normally mounted in an area close to the electronic components to cool off the components by moving the air that surrounds the components. According to the prior art, to lower the air temperature as the air temperature rises, the fan rotation speed is increased to increase the air flow rate. The increase in air flow rate results in lowering the surrounding air temperature. An increase in the rotation speed of the fan also increases the acoustic noise, and power consumption of the fan motor which also is a heat source. The acoustic noise and power consumption problems are both solved according to one or more embodiments of the present invention by eliminating any need to increase rotation speed while maintaining a control over the surrounding fluid temperature.

Figure 3:
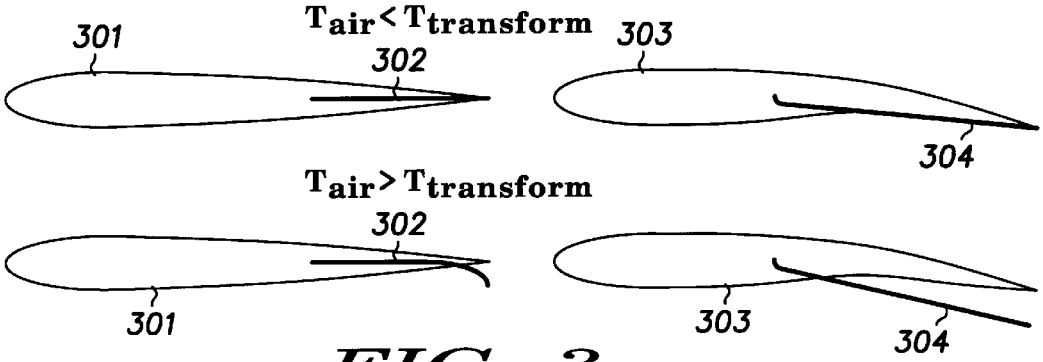
FIG. 3 depicts airfoil shapes of a fan blade coupled with a tail piece before and after a temperature change.

Referring to FIG. 3, in another embodiment of the invention, a fluid moving device, such as fluid moving device 100, includes a rotatable assembly, such as rotatable assembly 101, and a plurality of fan blades disposed circumferentially around and extending outward from the rotatable assembly, wherein at least one of the plurality of fan blades, such as fan blades 301 or 303, includes a tail piece, such as 302 or 304, coupled at a proximity of a trailing edge of the fan blade, wherein the tail piece includes a shape memory alloy. The fan blades 301 or 303 may be formed from plastic, wood, or metallic materials. The tail piece 302 or 304 is made of one of the memory shape alloys.

Referring to FIG. 4, details of fan blade 301 with a tail piece 302 in two coupling positions are shown. An angle 403 of tail piece 302 with respect to an angle of airfoil 404 of fan blade 301 at a trailing edge is changed to substantially a predetermined memory angle when tail piece 302 experiences a predetermined temperature. The predetermined memory angle changes overall camber of fan blade 301. The change in temperature may be as a result of rotation of rotatable assembly 101 in the fluid moving device at a given speed which causes the surrounding fluid to flow over fan blade 301 and tail piece 302. The predetermined memory angle changes the overall camber of fan blade 301 which results in an increase or decrease in volume flow of the surrounding fluid. The change in volume flow rate is accomplished while the rotation of the rotatable assembly is substantially maintained at a constant speed.

According to an embodiment of the invention, a method of controlling volume flow rate of a fluid moving device that includes a rotatable assembly and a plurality of fan blades coupled to the rotatable assembly, at least one of the plurality of fan blades having a trailing edge, includes coupling a tail to the fan blade at the trailing edge, wherein the tail includes a shape memory alloy, and rotating the rotatable assembly at a constant speed. At a predetermined temperature of surrounding fluid as passing over the fan blades, the volume flow rate of the fluid moving device changes according to the tail responding to the predetermined temperature which causes a change in an overall camber of the fan blade.

According to another embodiment of the invention, a method of limiting noise generated from a fluid moving device while changing volume flow rate of the fluid moving device that includes a rotatable assembly and a plurality of fan blades coupled to the rotatable assembly, at least one of the plurality of fan blades having a trailing edge, includes coupling a tail to the trailing edge, wherein the tail includes a shape memory alloy, and rotating the rotatable assembly at a constant speed. At a predetermined temperature of surrounding fluid as passing over the fan blades, the volume flow rate of the fluid moving device changes according to the tail responding to the predetermined temperature which causes a change in an overall camber of the fan blade. Any noise generated by the fluid moving device, thus, is limited since the rotation speed of the rotating assembly is maintained at a constant speed.

Power consumption and the generated acoustic noise from a fluid moving device play important factors into market desirability and performance optimization of many electronic products, such as personal computers, wireless communication products, compact cellular base stations, and alike. For example, a compact cellular base station may be mounted at a site which is in close proximity of people who can hear any fan noise generated from the fan that is used to remove the heat generated by the power amplifier in the base station. To limit annoyance of the fan noise, a low noise fan is highly desirable. Moreover, in case of power outage, the base station may run on reserve battery power which requires efficient use of power. In such situation, the power consumption of the cooling fan may constitute a large power drain. The present invention provides an efficient apparatus and method for moving air to remove heat in cellular base stations while conserving power consumption by eliminating additional control circuitry and running the fan at a constant speed, and reducing fan noise in noise sensitive sites. The expected temperature range of such an application is between 0 to 100 degree Celsius. Shape memory alloys that can be used at such a temertaure range are readily obtainable.

While the invention has been particularly shown and described with reference to a particular embodiment, it will be understood by those skilled in the art that various changes in form and details may be made therein without departing from the spirit and scope of the invention. The corresponding structures, materials, acts and equivalents of all means or step plus function elements in the claims below are intended to include any structure, material, or acts for performing the functions in combination with other claimed elements as specifically claimed.

What is claimed is:

1. A fluid moving device, comprising:

a rotatable assembly;

a plurality of fan blades disposed circumferentially around and extending outward from said rotatable assembly, wherein at least one of said plurality of fan blades comprises a tail piece coupled at a proximity of a trailing edge of said fan blade, wherein said tail piece comprises shape memory alloy.

2. The fluid moving device as recited in claim 1 wherein an angle of said tail piece with respect to an angle of airfoil of said fan blade at said trailing edge changes to substantially a predetermined memory angle when said tail piece experiences a predetermined transform temperature.

3. The fluid moving device as recited in claim 2 wherein said predetermined memory angle changes an overall camber of said fan blade.

4. The fluid moving device as recited in claim 1 wherein a predetermined temperature of surrounding fluid as passing over said fan blade causes an angle of said tail piece with respect to an angle of airfoil of said fan blade at said trailing edge to change substantially to a predetermined memory angle when rotation of said rotatable assembly at a given speed causes surrounding fluid to flow.

5. The fluid moving device as recited in claim 4 wherein said predetermined memory angle changes an overall camber of said fan blade.

6. The fluid moving device as recited in claim 4 wherein said predetermined memory angle increases volume flow of surrounding fluid when said rotatable assembly is rotating at said given speed.

7. The fluid moving device as recited in claim 4 wherein said predetermined memory angle decreases volume flow of said surrounding fluid when said rotatable assembly is rotating at said given speed.

8. A method of controlling volume flow rate of a fluid moving device, said fluid moving device comprising a rotatable assembly and a plurality of fan blades coupled to said rotatable assembly, at least one of said plurality of fan blades having a trailing edge, the method comprising the steps of:

coupling a tail piece to said fan blade at said trailing edge, wherein said tail piece comprises shape memory alloy; and rotating said rotatable assembly at a substantially constant speed, whereby said tail piece responding at a predetermined temperature of surrounding fluid as passing over said fan blades causes volume flow rate of said fluid moving device to change.

9. A method of limiting noise generated from a fluid moving device while changing volume flow rate of said fluid moving device, said fluid moving device comprising a rotatable assembly and a plurality of fan blades coupled to said rotatable assembly, at least one of said plurality of fan blades having a trailing edge, the method comprising the steps of:

coupling a tail piece to said trailing edge, wherein said tail comprises shape memory alloy; and rotating said rotatable assembly at a substantially constant speed, whereby said tail piece responding at a predetermined temperature of surrounding fluid as passing over said fan blades causes volume flow rate of said fluid moving device to change while said substantially constant speed limiting noise generated from said fluid moving device.

* * * * *